United States Patent [19]

Breen et al.

[11] Patent Number: 4,779,545

[45] Date of Patent: Oct. 25, 1988

[54] APPARATUS AND METHOD OF REDUCING NITROGEN OXIDE EMISSIONS

[75] Inventors: Bernard P. Breen, Laguna Beach, Calif.; James E. Gabrielson, Plymount, Minn.; Howard B. Lange, San Clemente, Calif.

[73] Assignee: Consolidated Natural Gas Service Company, Cleveland, Ohio

[21] Appl. No.: 159,677

[22] Filed: Feb. 24, 1988

[51] Int. Cl.[4] ..... F23B 5/00; F23C 9/00; F23G 7/06

[52] U.S. Cl. ..... 110/212; 110/214; 110/345; 422/183

[58] Field of Search ..... 431/2; 110/203, 212, 110/213, 214, 344, 345; 422/183

[56] References Cited

U.S. PATENT DOCUMENTS 4,515,089 5/1985 Ehrlichmann ..... 110/212 X
4,661,056 4/1987 Vickery et al. ..... 110/213 X

*Primary Examiner*—Edward G. Favors
*Attorney, Agent, or Firm*—Lynn J. Alstadt; Buchanan Ingersoll

[57] ABSTRACT

An apparatus and method for reducing nitrogen oxide emissions from furnace flue gas is provided in which a pulse generator introduces natural gas, or other fluid fuel which has little or no fixed nitrogen, into the upper portion of the furnace. The fuel pulse reacts with the nitrogen oxide in the flue gas to form ammonia-like compounds and nitrogen gas. These ammonia-like compounds react with additional amounts of nitrogen oxide in the flue gas to form nitrogen gas, water vapor and carbon dioxide. In this manner, the amount of nitrogen oxide in the flue gas is reduced using a process which can be easily applied to retrofitted furnaces.

7 Claims, 1 Drawing Sheet

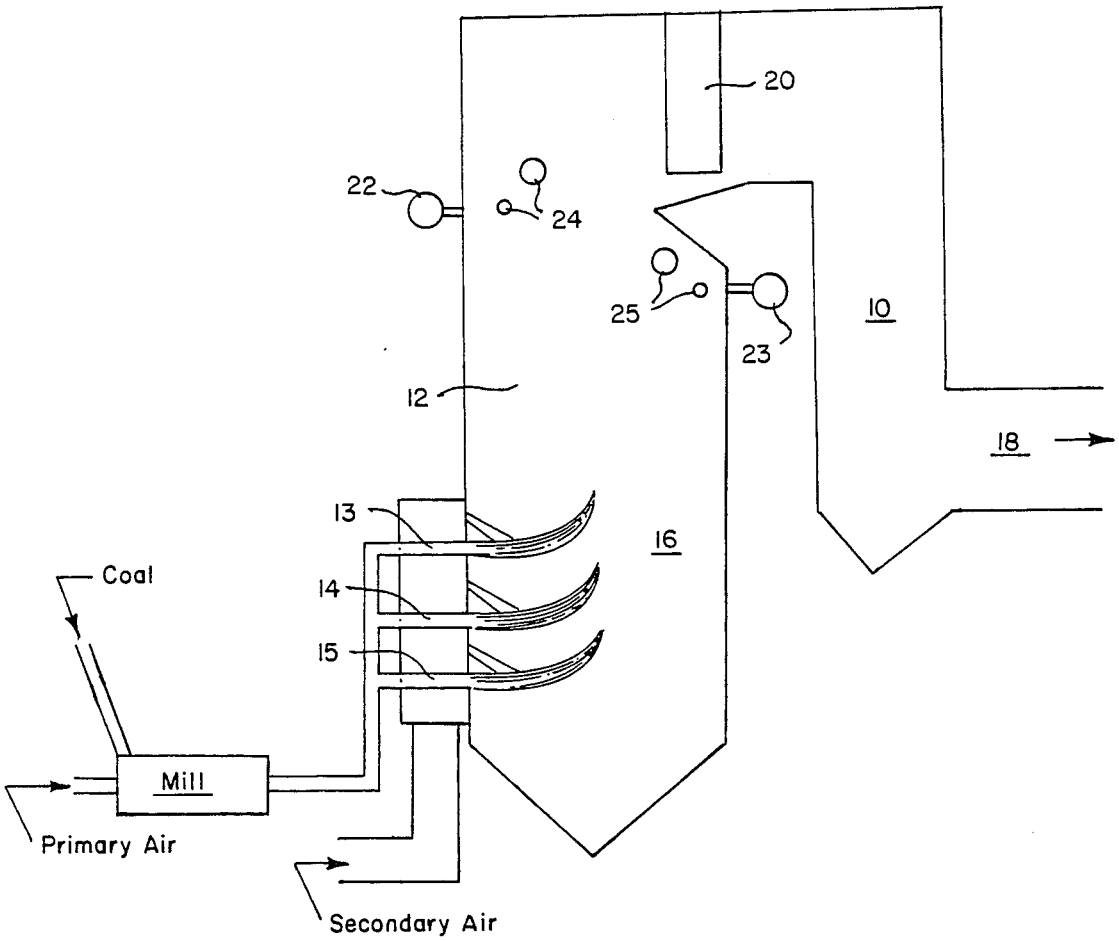
20
22
24
25
23
10
12
18
13
16
14
15
Coal
Mill
Primary Air
Secondary Air

APPARATUS AND METHOD OF REDUCING NITROGEN OXIDE EMISSIONS

BACKGROUND OF THE INVENTION

1. Field of the Invention

The present invention relates to an apparatus and method for in-furnace reduction of nitrogen oxide emissions in flue gas.

2. Description of the Prior Art

In the combustion of fuels with fixed nitrogen such as coal, oxygen from the air may combine with the nitrogen to produce nitrogen oxides. At sufficiently high temperatures, oxygen reacts with atmospheric nitrogen to form nitrogen oxides. Production of nitrogen oxide is regarded as undesirable. There are numerous government regulations which limit the amount of nitrogen oxide which may be emitted from a combustion furnace. Furthermore, the presence of nitrogen oxide in a furnace flue gas causes the condensed gases to become more corrosive and acidic. Consequently, there is a need for apparatus and processes which reduce the nitrogen oxide emissions in furnace flue gas.

Numerous attempts have been made to develop apparatus and processes which reduce the nitrogen oxide emissions in a furnace flue gas. One such approach is a process known as in-furnace nitrogen oxide reduction, reburning, or fuel staging. In reburning, coal, oil, or gas is injected above the normal flame zone to form a fuel-rich zone. In this zone, part of the nitrogen oxides are reduced to ammonia and cyanide-like fragments and $N_2$. Subsequently, air is injected to complete combustion. The reduced ammonia and cyanide-like fragments are then oxidized to form $N_2$ and nitrogen oxide.

Several problems occur when this process is used. First, coal may be an inefficient reburn fuel because of its high fixed-nitrogen composition. The fixed nitrogen introduced at this location in the furnace will have less chance of being converted to $N_2$, and therefore have a higher chance of ending up as nitrogen oxide and may, depending on the nitrogen oxide concentration of the flue gas, increase the emissions of nitrogen oxide.

Furthermore, the fuel must be injected with a sufficient volume of gas. If air is used as this gas, there must be enough fuel to consume the oxygen in the flue gas and air, and to supply an excess of fuel so reducing conditions exist. This increases the amount of fuel which must be used as reburn fuel. Furthermore, the necessity of using carrier air requires extensive duct work in the upper part of the furnace.

Additionally, the reburn fuel must be injected well above the primary combustion zone of the furnace so that it will not interfere with the reactions taking place therein. However, this fuel must be made so as to burn out completely without leaving a large amount of unburned carbon. To do this, the fuel must be injected in a very hot region of the furnace some distance from the furnace exit. The exit temperature of the furnace must be limited in order to preserve the heat exchangers' surface. Therefore, a tall furnace is required to complete this second stage process.

Moreover, the fuel must be injected in such quantities as to make the upper furnace zone fuel rich. This fuel is supplied in excess to the amount of air in the furnace and ultimately requires more air in order to be completely combusted. Thus, air must be injected above the reburn fuel injection. This requires even more duct work and furnace volume.

Finally, most coal furnaces which are now in operation are not designed to accommodate the prior art methods. Major modifications such as the provision of extensive ductwork and the addition of a second stage to the process are required to utilize the prior art method. Such retrofitting is expensive. Consequently, there is a need for a combustion apparatus and process which will reduce nitrogen oxide emissions in flue gas and which can be readily used in existing furnaces.

SUMMARY OF THE INVENTION

In accordance with the present invention there is provided an improved apparatus and process for reducing the nitrogen oxide emissions in furnace flue gas. A combustible fluid such as natural gas is introduced into the upper furnace through pulse combustors. These pulse combustors supply their own driving force and, since they educt air or flue gas, no duct work is needed to bring air into this upper zone of the furnace. Pulses of fuel-rich combustion products are introduced directly in the upper section of the furnace where they mix with air-rich combustion products coming from the coal burner in the furnace. Fuel-rich eddies develop around these pulses. In these eddies the nitrogen oxide formed in the coal burner will be reduced to ammonia and cyanide-like fragments and $N_2$. As these eddies decay and mix with more of the flue gas, they experience an oxidizing environment, where the ammonia-like compounds react with more of the nitrogen oxide to form $N_2$ and water, and the excess fuel and nitrogen fragments react with the oxygen. As a result, the nitrogen oxide in the flue gas is reduced at the same time that the combustion of the natural gas is completed.

Because of the simplicity of this system, it is ideal for retrofitting existing coal furnaces. Because the process relies on controlled mixing to provide fuel-rich and then air-rich environments, there is no need for an air addition stage. Because gas burns more rapidly at a lower temperature than coal, the fuel can be introduced at a higher elevation and lower temperature. This lower temperature acts to reduce the equilibrium level of nitrogen oxide in the flue gas and, hence, increases the nitrogen oxide reduction possible. Finally, duct work is not necessary for injection air nor for completion air. As a consequence, the cost of reducing the nitrogen oxide emissions in the flue gas is greatly reduced. Other objects and advantages of the invention will become apparent as a description of the preferred embodiments proceeds.

BRIEF DESCRIPTION OF THE DRAWING

The drawing is a schematic drawing of an apparatus for reducing nitrogen oxide emissions in accordance with the principles of the present invention.

DESCRIPTION OF THE PREFERRED EMBODIMENT

As shown in the drawing, our improved apparatus for reducing nitrogen oxide emissions in furnace flue gas 10 can be readily retrofitted to an existing furnace 12. The furnace 12 is designed to consume coal or any other fuel. The fuel enters the furnace 12 by way of fuel entries 13, 14 and 15, which are located in the bottom portion of the furnace 12. It burns in primary combustion zone 16 which typically has a temperature of about 3000° F. Flue 18 provides an exit for the flue gas which is created in primary combustion zone 16 during the combustion of the fuel. The flue gas has a temperature in the range of 2100° F. to 2400° F. when it exits the furnace near heat exchangers 20. Heat exchangers 20 in the upper portion of the furnace cause the temperature drop of the flue gas. During the combustion of the fuel, some of the fixed nitrogen reacts with oxygen to form nitrogen oxide, $NO_x$, and some $NO_x$ is formed from atmospheric nitrogen and oxygen.

We provide pulse combustors 22 and 23 to reduce the nitrogen oxide emissions in the flue gas. The pulse combustors 22 and 23 introduce pulses 24 and 25 of natural gas, or other fuel having little or no fixed nitrogen content, and educted air or flue gas into the upper portions of the furnace 12 above primary combustion zone 16. The pulse combustors are driven by the pressure caused by the intermittent combustion within them, so, the gas entering the furnace usually contains residual air and fuel but mostly combustion products. Other fluid fuels which usually contain little fixed nitrogen include those of the general form $C_xH_y$ and $C_xH_yO_2$. The pulses of fuel create fuel-rich eddies which, following the initial fuel-rich equilibration, mix with the flue gas to complete the oxidation of the fuel.

The natural gas pulse, as it begins to burn, reacts with a portion of the nitrogen oxide in the flue gas to form molecular nitrogen, $N_2$, ammonia, $NH_i$, and cyanide-like fragments, HCN:

(1) $CH_4+NO_x \rightarrow N_2+NH_i+HCN$

As the pulse of fuel completes its combustion, the cyanide-like fragments react to form ammonia-like compounds which react with additional nitrogen oxide in the flue gas to form $N_2$ and water vapor:

(2) $NH_i+NO_x \rightarrow N_2+H_2O$

These equations characterize the process but do not show all reactions, pathways and intermediate species which may occur.

We introduce the pulses of natural gas in the upper portion of the furnace so that the pulse does not interfere with the primary combustion of the coal taking place in the furnace below. Because natural gas, which burns more readily and rapidly than coal, is used as the fuel pulse, it can be introduced at a level in the furnace where the temperature is in the range of 2100° F. to 2400° F. Since this is the desired exit temperature of the flue gas from the furnace, our pulse combustors 22 and 23 can be located near the flue gas exit. The need for second stage air addition to the furnace 12 has also been eliminated. This lower temperature also reduces the temperature-dependent equilibrium level of nitrogen oxide and allows greater reduction of nitrogen oxide.

Our pulse generators 22 and 23 are self-driving. Because the pulse generators educt their own combustion air, there is no need for an air duct to bring pressurized air up to the pulse combustors. Since no duct work is needed to carry the air to the upper portions of the furnace 12, this major retrofitting problem for those furnaces which have no space to accommodate any duct work has been eliminated.

The pulses of natural gas reduce the amount of nitrogen oxide in the flue gas in four ways. First, the natural gas does not contain any fixed nitrogen. Consequently, unlike a fuel containing fixed nitrogen, the combustion of natural gas creates very little additional nitrogen oxide. Second, the natural gas reduces the amount of nitrogen oxide in the flue gas directly by the chemical reactions set forth in equations (1) and (2) above. Third, the natural gas also reduces the amount of nitrogen oxide by consuming the excess oxygen in the flue gas. The reduction in the amount of oxygen in the flue gas reduces the equilibrium level of nitrogen oxide in the flue gas. Finally, since the natural gas is introduced at a higher level in the furnace where the temperature is lower, the equilibrium level of nitrogen oxide is lower, allowing for more complete reduction. In this manner, our pulse combustors 22 and 23 provide effective reduction of nitrogen oxide in furnace flue gas.

In addition to providing a suitable reduction in the amount of the nitrogen oxide in the flue gas, our invention is cost-effective as a retrofit to existing coal furnaces. No additional duct work is necessary for our pulse generators 22 and 23. Furthermore, our pulse generators can be placed near the flue gas exit and still be within a proper operating temperature, eliminating the need for second stage air addition to the furnace. Finally, our system is so simple, that it can be inexpensively applied to retrofit any fossil fuel fired furnace currently in use.

A further improvement to this invention is to use flue gas rather than air as the oxidizing fluid in the pulse combustors. This improvement allows less gas to be used in order to reach the desired air/fuel ratio since no air is introduced through the pulse combustors. This has the additional advantage of not increasing the gas flow through the convective passes, producing a richer combustion pulse, and directly reducing some of the flue gas nitrogen oxide in the combustion pulse.

While we have shown and described a present preferred embodiment of the invention and have illustrated a present preferred method of practicing the same, it is to be distinctly understood that the invention is not limited thereto but may be otherwise variously embodied and practiced within the scope of the following claims.

We claim:

1. An improved apparatus for reducing nitrogen oxide in flue gas in a furnace wherein a fuel is burned in a primary combustion zone to produce a flue gas containing nitrogen oxide wherein the improvement comprises:

at least one pulse combustor attached to the furnace above the primary combustion zone which introduces into the flue gas pulses of a fluid selected from the group of fluids consisting of natural gas, $C_xH_y$ compounds and $C_xH_yO_2$ compounds and one of air, flue gas, and a combination of air and flue gas.

2. The apparatus in claim 1 wherein said pulse combustors are positioned to introduce said fluid into a region of said furnace wherein the flue gas is at a temperature in the range of 2100° F. to 2400° F.

3. The apparatus in claim 1 wherein the combustor is sized to inject pulses of fluid in sufficient quantities to promote a reaction of the fluid with a first portion of said nitrogen oxide in said flue gas to form ammonia compounds, $N_2$, water and carbon dioxide, and said ammonia compounds further react with a second portion of said nitrogen oxide in said flue gas to from $N_2$, water and carbon dioxide.

4. A method for reducing nitrogen oxide in flue gas comprising the step of:

injecting pulses of a fluid selected from the group of fluids consisting of natural gas, $C_xH_y$ compounds, $C_xH_yO_2$ compounds, and mixtures primarily of these compounds into the flue gas in sufficient quantities to promote a reaction between the nitrogen oxide in the flue gas and the fluid to form ammonia compounds and $N_2$ and to promote a secondary reaction of said ammonia compounds and additional nitrogen oxide from the flue gas to form $N_2$, water and carbon dioxide.

5. The method in claim 4 wherein the flue gas has a temperature within the range of 2100° F. to 2400° F.

6. A method for reducing nitrogen oxide in flue gas comprising the step of:

injecting pulses of a mixture formed by the reaction between educted flue gas and a fluid selected from the group of compounds consisting of $C_xH_y$ compounds, $C_xH_yO_2$ compounds, and mixtures primarily of these compounds into the flue gas in sufficient quantities to promote a reaction between the nitrogen oxide in the flue gas and the fluid to form ammonia-like compounds and $N_2$ and a secondary reaction of said ammonia-like compounds and additional nitrogen oxide from the flue gas to form $N_2$, water and carbon dioxide.

7. The method in claim 6 wherein the flue gas has a temperature within the range of 2100° F. to 2400° F.

* * * * *